US005095686A

United States Patent [19]

Marshall et al.

[11] Patent Number: 5,095,686

[45] Date of Patent: Mar. 17, 1992

[54] PRODUCE BAGGING MACHINE

[75] Inventors: Dale E. Marshall, Haslett; Galen K. Brown, Okemos; Richard J. Wolthuis, Haslett; Clyde L. Burton, East Lansing, all of Mich.

[73] Assignee: The United States of America as represented by the Secretary of Agriculture, Washington, D.C.

[21] Appl. No.: 540,982

[22] Filed: Jun. 20, 1990

[51] Int. Cl.[5] ..... B65B 5/06; B65B 43/16

[52] U.S. Cl. ..... 53/571; 53/247; 53/260; 53/384.1

[58] Field of Search ..... 53/241, 247, 249, 255, 53/260, 384, 385, 386, 570, 571, 573, 251, 77, 384.1; 198/477.1

[56] References Cited

U.S. PATENT DOCUMENTS

| | | | |
|---|---|---|---|
| 2,751,134 | 6/1956 | Walldow | 53/385 |
| 2,833,097 | 5/1958 | Petrea et al. | 53/386 |
| 2,950,589 | 8/1960 | Litchard | 53/373 |
| 3,150,775 | 9/1964 | Barrett | 198/477.1 X |
| 3,161,003 | 12/1964 | Grintz | 53/255 |
| 3,699,741 | 10/1972 | Norman | 53/385 X |
| 3,774,370 | 11/1973 | Fried | 53/255 |
| 3,830,038 | 8/1974 | Propst | 53/573 X |
| 3,864,894 | 2/1975 | Sheetz et al. | 53/77 X |
| 4,078,358 | 3/1978 | Henderson | 53/573 X |

FOREIGN PATENT DOCUMENTS

| | | | |
|---|---|---|---|
| 770930 | 10/1980 | U.S.S.R. | 53/570 |
| 1460897 | 1/1977 | United Kingdom | 53/573 |

*Primary Examiner*—John Sipos

*Attorney, Agent, or Firm*—M. Howard Silverstein; Randall E. Deck; John D. Fado

[57] ABSTRACT

An apparatus for the mechanical bagging or packaging of produce or other articles susceptible to damage upon impact. The apparatus includes a tiltable support for temporarily holding a quantity of produce and having an end portion for discharging the produce or articles when tilted. A bag positioning assembly is provided to position a bag around the support such that the end portion of the support is nearly adjacent the closed end of the bag. When the support is tilted, the produce or articles will settle towards the closed end of the bag. Because the bag is positioned around the support, the impact and damage to the produce or articles is minimized.

18 Claims, 7 Drawing Sheets

PRODUCE BAGGING MACHINE

BACKGROUND OF THE INVENTION

1. Field of the Invention

This invention relates to the mechanical bagging or packaging of produce or other articles susceptible to damage upon impact.

2. Description of the Prior Art

Conventional bagging devices currently in use employ a pan into which produce or articles are placed and a bag positioned below the pan outlet. To deposit the produce or articles in the bag, the pan is tipped, dumping the produce into the bag. This results in the produce falling as much as 50 cm into an empty bag. Considerable bruising results in fruits or vegetables when the energy of the falling articles is absorbed on impact with hard surfaces or other articles already in the bag.

SUMMARY OF THE INVENTION

The invention relates to an apparatus for bagging or packaging produce or other articles susceptible to damage upon impact. The apparatus includes at least one tiltable support for receiving and temporarily holding a quantity of the produce or articles in an approximately horizontal position. The support is provided with an open end portion for discharging the produce or articles when the support is tilted to a nonhorizontal position. Bags are provided from a bag supply, each bag having an open end and a closed end. The apparatus further includes a device for positioning the open end of a bag around the support means, such that the discharge end of the support is adjacent to the closed end of the bag. The apparatus functions to simultaneously tilt the support and the surrounding bag from the approximately horizontal position to an extent such that the produce on the support will settle under gravity toward the closed end of the bag. Subsequently, the apparatus removes the support from the bag, returning to its original, approximately horizontal position ready to receive another quantity of produce and repeat the bagging sequence.

The object of the invention is to minimize the impact received by produce or other articles susceptible to damage as they are put into bags by minimizing the height the objects drop as they proceed from an accumulated position, such as a hopper or support, into the bag. The apparatus of the invention puts the bag over the produce or articles accumulated in the hopper or support before it is tipped. With the bag in place, the support tips and the produce or articles settle down into the bag as the support reaches the bottom of its sequence.

LIST OF FIGURE REFERENCE NUMERALS

Figure 1:
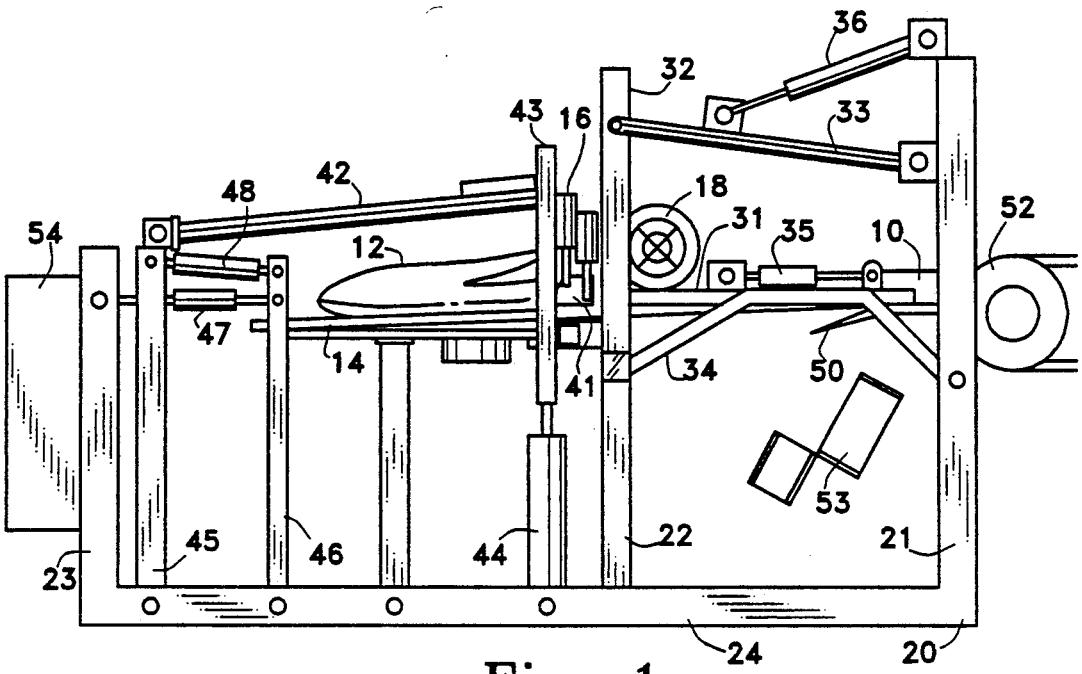
FIG. 1 is a side view of the apparatus at rest as at the beginning of the cycle (start position).

10—support
12—bag
14—bag holder assembly
16—bag positioning assembly
18—first blower
20—frame
21—first upright frame member
22—second upright frame member
23—third upright frame member
24—horizontal frame member
31—arm
32—support yoke
33—upper link
34—lower link
35—first extensible/retractable reciprocating element
36—second extensible/retractable reciprocating element
41—bag grippers
42—third extensible/retractable reciprocating element
43—lift yoke
44—fourth extensible/retractable reciprocating element
45—first brace
46—second brace
47—fifth extensible/retractable reciprocating element
48—sixth extensible/retractable reciprocating element
49—seventh extensible/retractable reciprocating element
50—releasable bag-retaining device
52—first conveyor means
53—second conveyor means
54—computer control means
60—track or rail

DETAILED DESCRIPTION OF THE INVENTION

The present invention was designed for bagging or packaging produce or other articles susceptible to damage upon impact. The device is especially suited for bagging fruits and vegetables, such as apples, onions, oranges, peaches, etc.

Referring now to FIGS. 1–8, the apparatus includes at least one tiltable support 10, bag holder assembly 14, and a bag positioning assembly 16.

The tiltable support 10 functions to receive and temporarily hold a quantity of the articles while in an approximately horizontal position. The support 10 may be, for example, a pan, tray, or hopper and is provided with an open end portion for freely and unrestrainedly discharging the articles when the support is tilted to a nonhorizontal position.

The bag holder assembly 14 functions to provide a supply of bags 12 to the bag positioning assembly 16. The bag holder assembly may include, for example, a support holding a stationary supply of bags thereon as with a wicket and/or an automatic bag supply device.

The bag positioning assembly 16 functions to engage a bag 12 and position the open end of the bag around or over the support 10 such that the support is at least partially inserted into the bag, and wherein the end portion of the support 10 is near or adjacent to the closed end of the bag. It is understood that the term "adjacent" as used herein encompasses the open end portion of the support and the closed end of the bag being in or out of contact with one another. While the actual distance from the end of the support to the closed end of the bag will vary depending upon the sensitivity of the articles to damage upon impact, it is preferred that the distance be about 0–5 cm, and particularly 1–2 cm. However, one of skill in the art will recognize that the distance may be greater for less delicate articles.

In the preferred embodiment shown in FIGS. 1–8, the apparatus includes a frame 20 having first, second, and third upright members 21, 22, and 23, respectively, and a base or horizontal member 24. The support 10, bag holder assembly 14, and bag positioning assembly 16 are all directly or indirectly supported by the frame.

The support 10 is directly or indirectly pivotably attached to one end of arm 31 which is joined nearly perpendicularly at the other end thereof to support yoke 32. The support yoke 32 in turn is moveably attached via pivoting upper and lower links 33 and 34, respectively, to the first upright member 21 of the frame 20. The support is caused to pivot or tilt by first extensible/retractable reciprocating elements 35 joined at opposite ends to the arm 31 and support 10 as clearly shown in FIGS. 5, 6, and 8. Upon completion of tilting of the support 10 and discharge of the articles within the bag 12, the support is raised out of the bag 12 by action of second reciprocating elements 36 joined at opposite ends to upper link 33 and the upper portion of the first upright frame member 21. Upon retraction of the second reciprocating elements 36, the support yoke 32 and consequently support 10 are raised as specifically shown in FIG. 6.

The reciprocating elements of the present invention are preferably pneumatic or hydraulic cylinders. Alternatively, other conventional elements could be employed for effecting movement of the apparatus components, such as ball screws or ropes and pulleys, as will be recognized by those skilled in the art.

Also, as shown in the FIGS., the bag positioning assembly 16 includes at least one, and preferably a pair of, bag grippers 41 which are moveable in relation to the support 10 and the bag holder assembly 14. Movement of the bag grippers 41 in this manner is provided by attachment of the bag grippers to one end of the third reciprocating elements 42. The third reciprocating element 42 in turn is pivotably connected at or near the end adjacent the bag grippers 41 to lift yoke 43. Lift yoke 43 functions to vertically raise or lower the third reciprocating element and hence bag grippers 41 by virtue of its connection at the lower end thereof to fourth reciprocating element 44. The fourth reciprocating element 44 is pivotably connected at approximately its lower end to horizontal member 24 of the frame.

Further movement of the bag grippers 41 may be effected by pivotable attachment of the third reciprocating element 42, at or near the end opposite that attached to bag grippers 41, to first brace 45, which is pivotably attached at its lower end to the horizontal frame member 24 between the second and third upright frame members 22 and 23. A second brace 46 is further provided between the first brace 45 and the second upright frame member 22, also pivotable attached to the horizontal frame member 24. By providing fifth reciprocating elements 47 joining the third upright frame member 23 and the second brace 46, and sixth reciprocating elements 48 joining the first and second braces 45 and 46, pivotable movement of the braces and thus the third reciprocating element 42 and bag grippers 41 is effected. The fifth and sixth reciprocating elements are preferably connected at or near the upper portions of the first and second braces 45 and 46 and the third upright frame member 23. Further details of the method of operation of these first and sixth reciprocating elements are described in the Method of Operation below.

Figure 2:
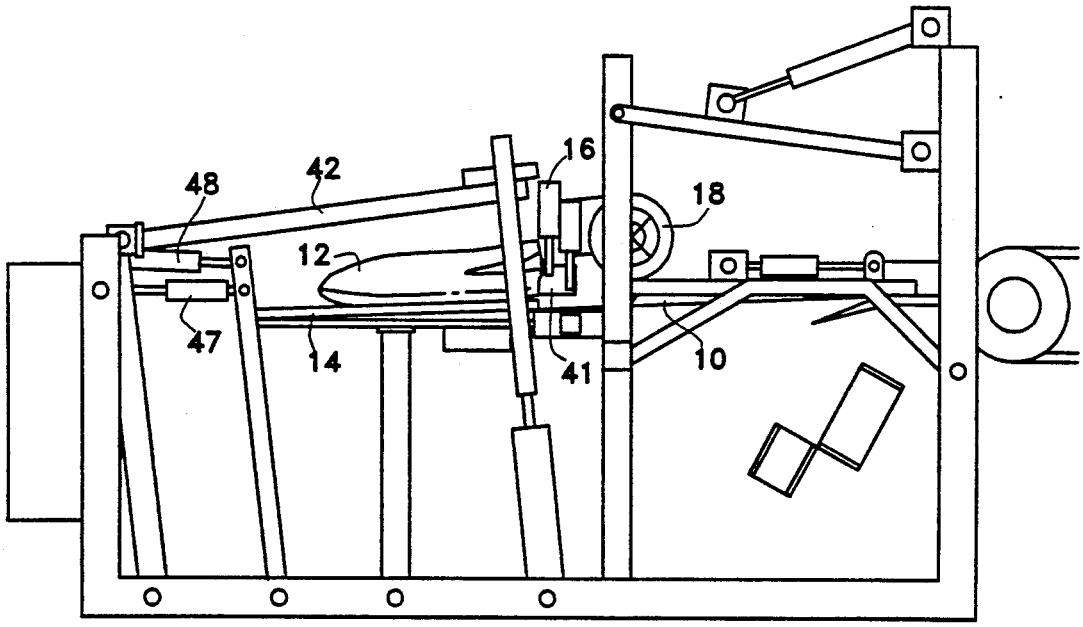
FIG. 2 is a side view of the apparatus showing the bag grippers moved to engage and remove a bag from the bag holder.

Although preferred, the fifth and sixth reciprocating elements 47 and 48 may be omitted and the third reciprocating element 42 constructed such that it could either be extended of further retracted from the starting position of FIG. 1 to a position as shown in FIG. 2. In this embodiment, the end of the third reciprocating element 42 opposite the bag grippers 41 could be pivotably attached to the frame as at the upper portion of the third upright member 23.

Figure 8:
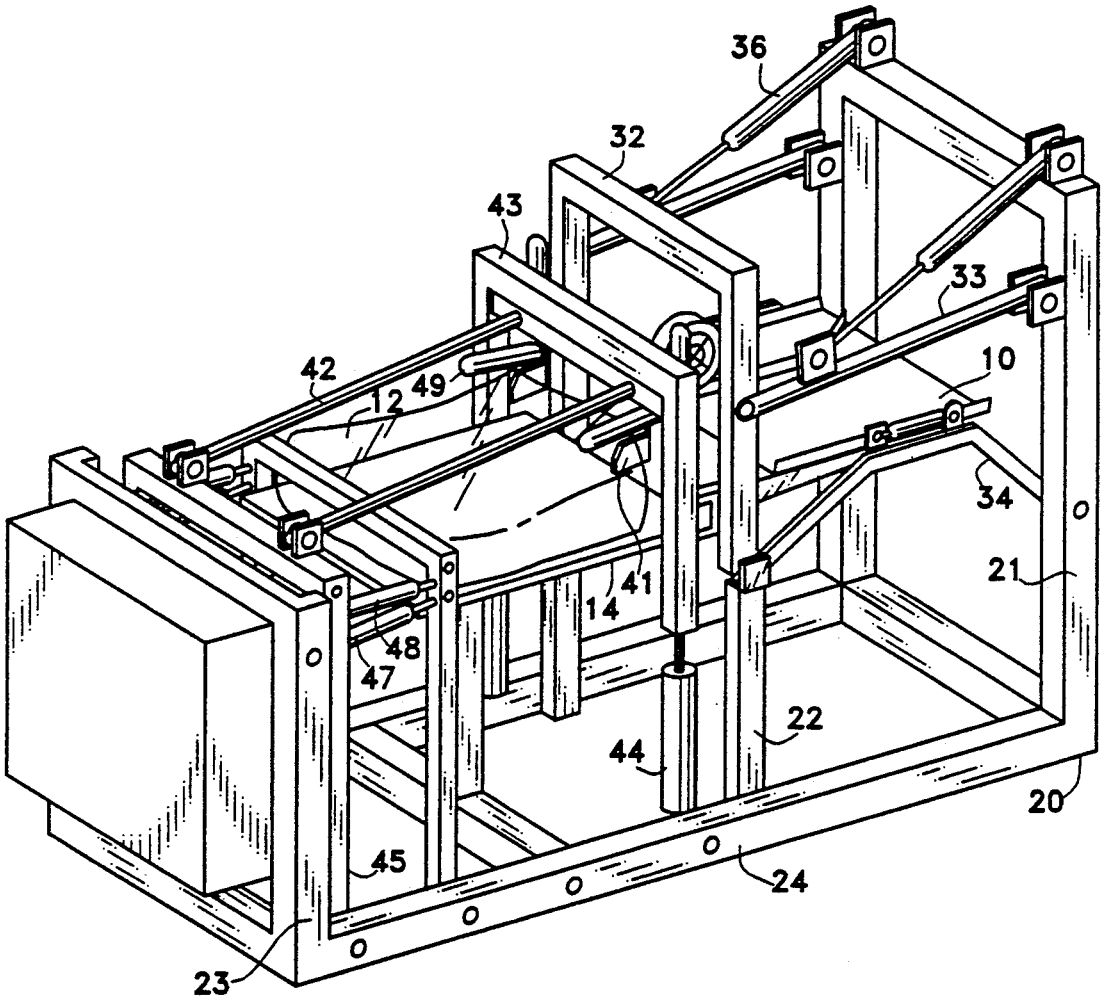
FIG. 8 is a perspective view of the apparatus.

As shown in FIG. 8, each bag gripper 41 of the preferred embodiment has a gripping and release mechanism constructed from a pair of opposed surfaces in the form of parallel plates or other shapes which may be moved together or apart (open or closed) for gripping or releasing the bag, respectively. The bag grippers 41 may also be provided with at least one seventh reciprocating element 49 to effect relative movement of the opposed surfaces. In the alternative, the structure of the bag retaining means could be varied using clamps, clips, or other releasable grippers conventional in the art. Further, a suction source could be employed or the gripper could be formed from two opposed surfaces which are both inserted into the bag and moved apart to frictionally engage the inside wall of the bag at opposite sides.

In addition, a first blower 18 may be provided and is positioned to blow air into the bags 12 to prevent their collapse and maintain the bags in an inflated condition. Blowing air into the bags allows for easier insertion of the support into the end of the bag without snagging. In the preferred embodiment, the blower 18 is attached to the bag positioning assembly 16. Blower 18 may includes a guillotine valve or switch to control its operation, as will be described in the Method of Operation below.

A second blower (not shown) may also be included and is positioned to blow air into the bag 12 after it is positioned around the support 10. The second blower would also function to prevent the bag from collapsing and allow articles on the support to more easily roll through the open end of the bag. Preferably, the second blower is positioned at or near the upper portion of the first upright frame member 21.

Figure 3:
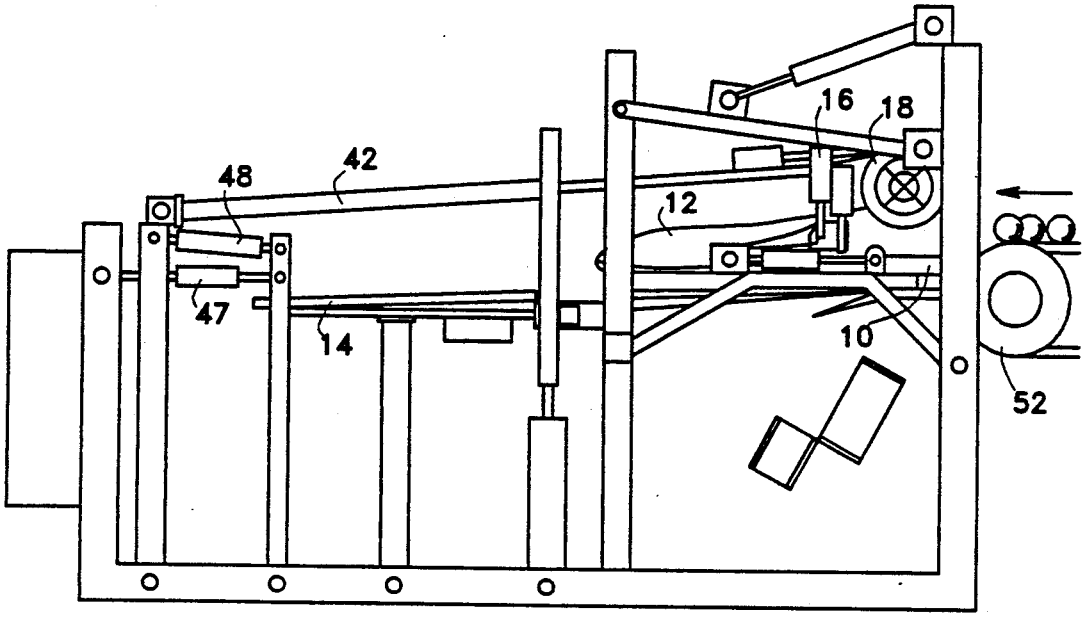
FIG. 3 is a side view showing the bag grippers moved to position a bag over the support being supplied with produce.
Figure 4:
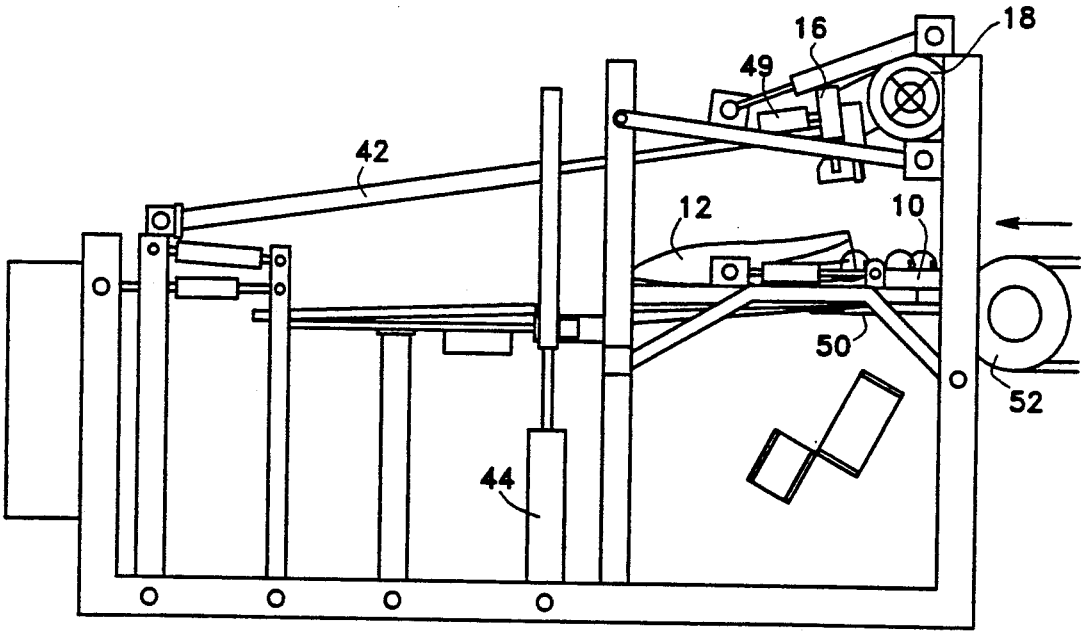
FIG. 4 is a side view showing the bag grippers lifted away from the support holding produce and surrounded by a bag.

The apparatus of the instant invention further includes a releasable bag retaining device 50 for releasably retaining a bag 12 over the support 10 and for preventing the bag from being inadvertently removed from the support. In the preferred embodiment, the bag retaining device comprises an openable/closable pad having a contacting face formed of a high friction material such as rubber, or a brush or clamp positioned on or near the bottom of the support 10. In the closed position, the device frictionally engages the bag against the underside of support 10 as shown in FIGS. 3 and 4. In an alternate embodiment, the bag retaining means could comprise a vacuum/air pressure source impinging upon the bag and underside of the support. The application of a positive pressure as the bag is placed around the support would reduce friction and allow easier positioning of the bag around the support. After the bag is in place, application of a vacuum would retain the bag on the support.

Supply of the articles to the support 10 may be effected manually or mechanically. In the preferred embodiment, a first conveyor means 52 is provided to transport the desired number or weight of articles to the apparatus where they are loaded or dispensed onto support 10.

Receipt and transport of the filled bags after the support 10 is tilted may also be accomplished manually or mechanically. In the preferred embodiment, a second conveyor means 53 is provided below the support and positioned to receive the bag filled with the articles such that the bag does not drop a substantial distance from the support to the second conveyor 53. This second conveyor may be in the form of an "L" belt as shown in the FIGS. or any other conventional conveyor device. Preferably, the conveyor means 52 and 53 are cushioned to further limit damage to the articles.

Operation of all or part of the apparatus may be subject to automatic computer control 54 or manual control. Contact switches may be provided for effecting operation of any of the individual components of the apparatus.

METHOD OF OPERATION

The operation of the preferred embodiment of the invention as depicted in FIG. 1–8 is now described. In use, a supply of bags 12 is provided by the bag holder assembly 14 as shown in FIG. 1. Operation of the apparatus is initiated by moving the bag positioning assembly 16 with bag grippers 41 to engage and remove a bag from the bag holder 14. This movement is effected by retraction of the fifth reciprocating elements 47, inserting the bag grippers into the open end of the bag 12. Seventh reciprocating elements 49 then retract causing the grippers 41 to grip the bag. Subsequently, sixth reciprocating elements 48 extend, removing the bag off the bag holder assembly 14 and/or wicket (FIG. 2).

As shown in FIG. 3, after removable of the bag from the bag holder assembly 14, the bag positioning assembly 16 is moved to position the bag 12 over the support 10. This is achieved by extending the third and fifth reciprocating elements 42 and 47, the retracting reciprocating element 48, respectively. Alternatively, this movement may be effected by extension of the third reciprocating element 42 alone. Extension of the bag over the support is aided by operation of the first blower 18 which functions to prevent collapse of the bag and thus snagging of the bag opening by the support as it is inserted. At the approximate time that the bag is positioned over support 10, a measured quantity of the articles to be bagged is delivered to the support by means of conveyor 52.

FIG. 4 illustrates the subsequent removal of the bag positioning assembly 16 from the support 10 and retention of the bag 12 around the support. To prevent inadvertent movement or removal of bag 12, releasable bag retaining device 50 is moved to a closed position to clamp the bag onto the support. Seventh reciprocating elements 49 are extended, releasing the bag grippers 41; the fourth reciprocating element 44 are also extended, lifting the bag positioning assembly 16 above the support. In addition, if the first blower 18 includes a guillotine valve or other switch, the first blower may be shut off at this time. The second blower would then aid in maintaining the bag in an open position without collapse, allowing easier entry of the articles into the bag from the support. Subsequently, the third reciprocating elements 42 may be retracted to return the bag positioning assembly 16 back toward the start position. If not provided previously, articles may be supplied onto the support by conveyor 52 during this step.

Figure 5:
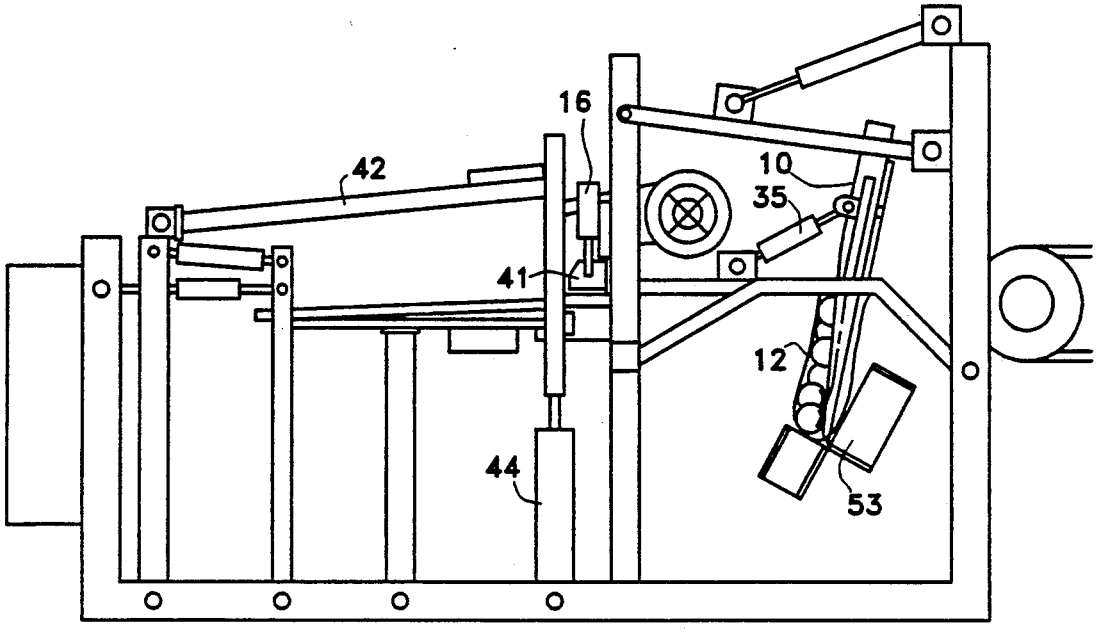
FIG. 5 is a side view showing the tipping of the support and surrounding bag and the return of the bag grippers to their start position.

Tipping of the support 10 and settling of the articles toward the closed end of the bag 12 is shown in FIG. 5. The articles nearest the discharge end of the support and near the bottom of the bag will tend to restrain the articles from falling any appreciable distance. The tipping action is caused by retraction of the first reciprocating element 35. As the support is tipped, the bag 12 with the articles thereon is received on or near (slightly above) the second conveyor means 53. If not completed previously, by bag positioning assembly 16 with bag grippers 41 is returned to its starting position (shown in FIG. 1) by retracting the third reciprocating elements 42 as mentioned above, and by retracting the fourth reciprocating elements 44, thereby lowering the bag positioning assembly.

Figure 6:
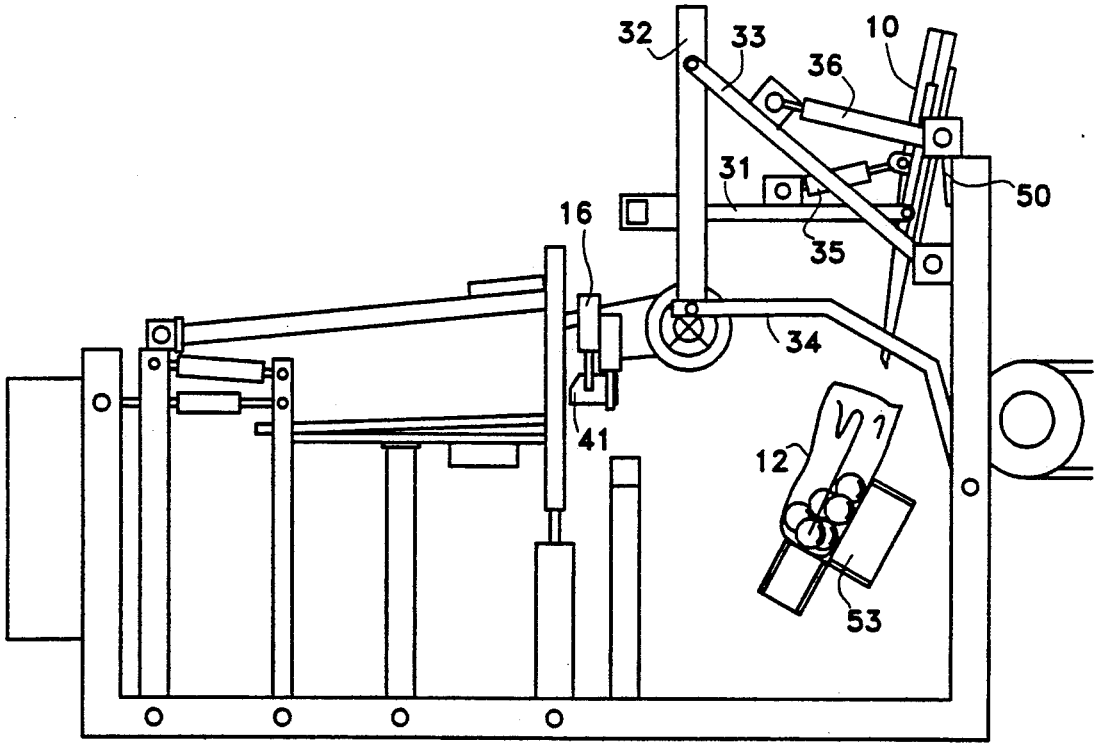
FIG. 6 is a side view showing the support in a retracted position removed from the bag.
Figure 7:
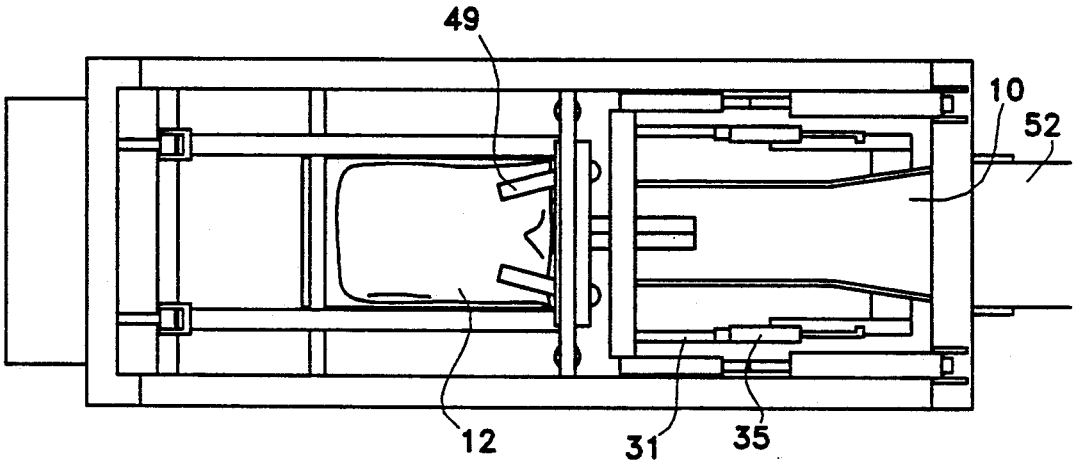
FIG. 7 is a top view of the apparatus in the start position.

As shown in FIG. 6, the support 10 is removed from the bag 12 by releasing the bag retaining device 50 and retracting the second reciprocating elements 36. The bag containing articles is then free to be removed by the second conveyor means 53. Following removal of the bag, the support 10 is returned to its starting position as shown in FIG. 1 by extension of both the first and second reciprocating elements 35 and 36. The entire cycle is subsequently repeated for filling of additional bags.

Alternative Embodiments

In the alternative to the preferred embodiment described above, the support 10 need not be lifted out of the bag following tilting; and the components for effecting this action may be omitted. After tilting of the support, the bag may be displaced vertically downward by means of a conveyor or the like. The conveyor would intercept the filled bag and gradually lower it away from the downwardly oriented support.

Figure 10:
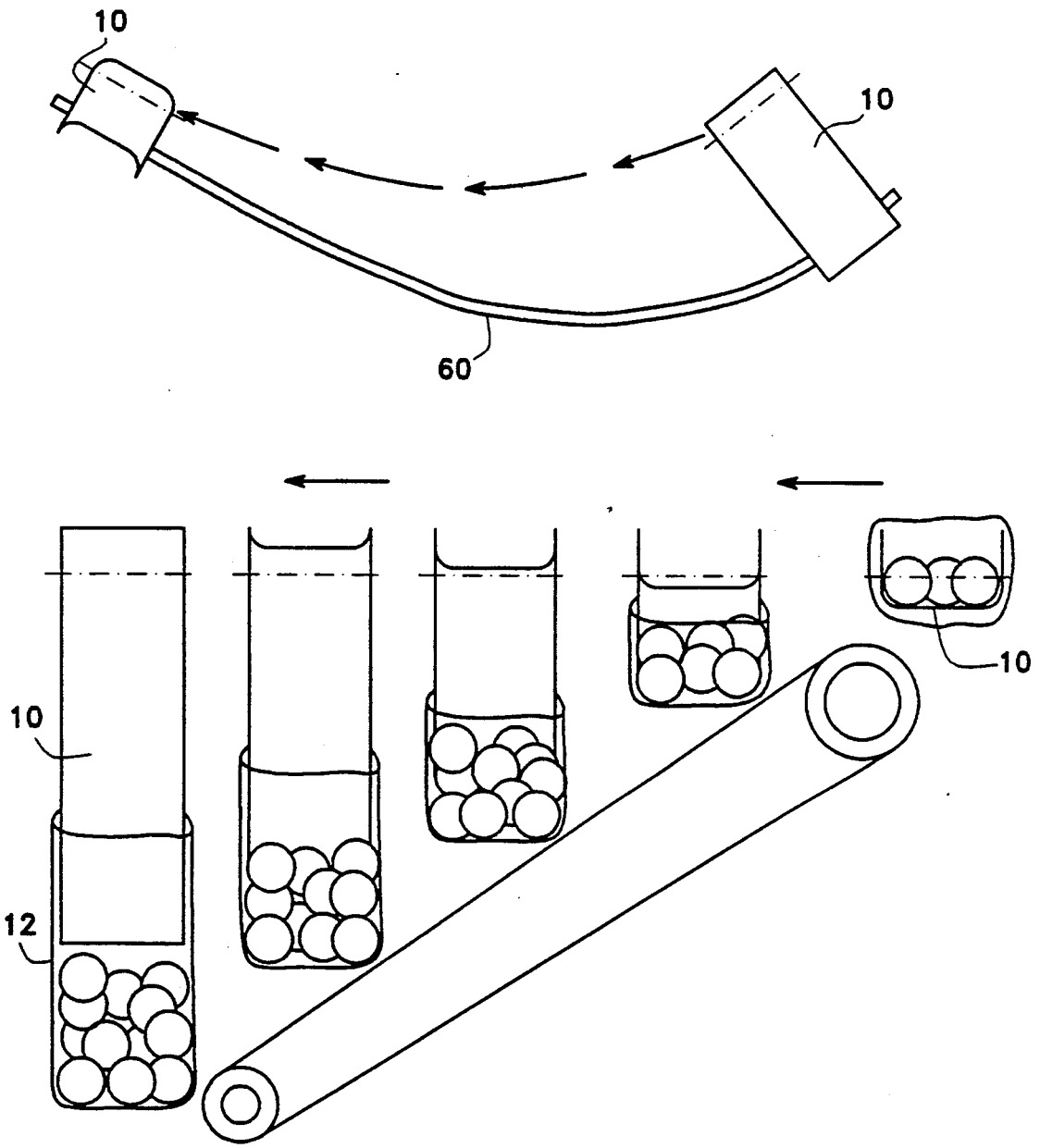
FIG. 10 is a top and side view of an alternative embodiment wherein the support is rotated and tilted.

In one variation of this embodiment, shown in FIG. 10, means are provided for simultaneously tilting the support downwardly and rotating it in a horizontal plane with the discharge end portion extending radially outwardly. The second conveyor positioned below the support is inclined and is positioned below the path of rotation of the discharge end of the support. The upper portion of the conveyor contacts the bottom of the bag while it is still positioned around the support at or near its approximately horizontal position. In this manner, the bag is gradually removed from the support onto the inclined conveyor as the support continues to tilt and rotate.

Figure 9:
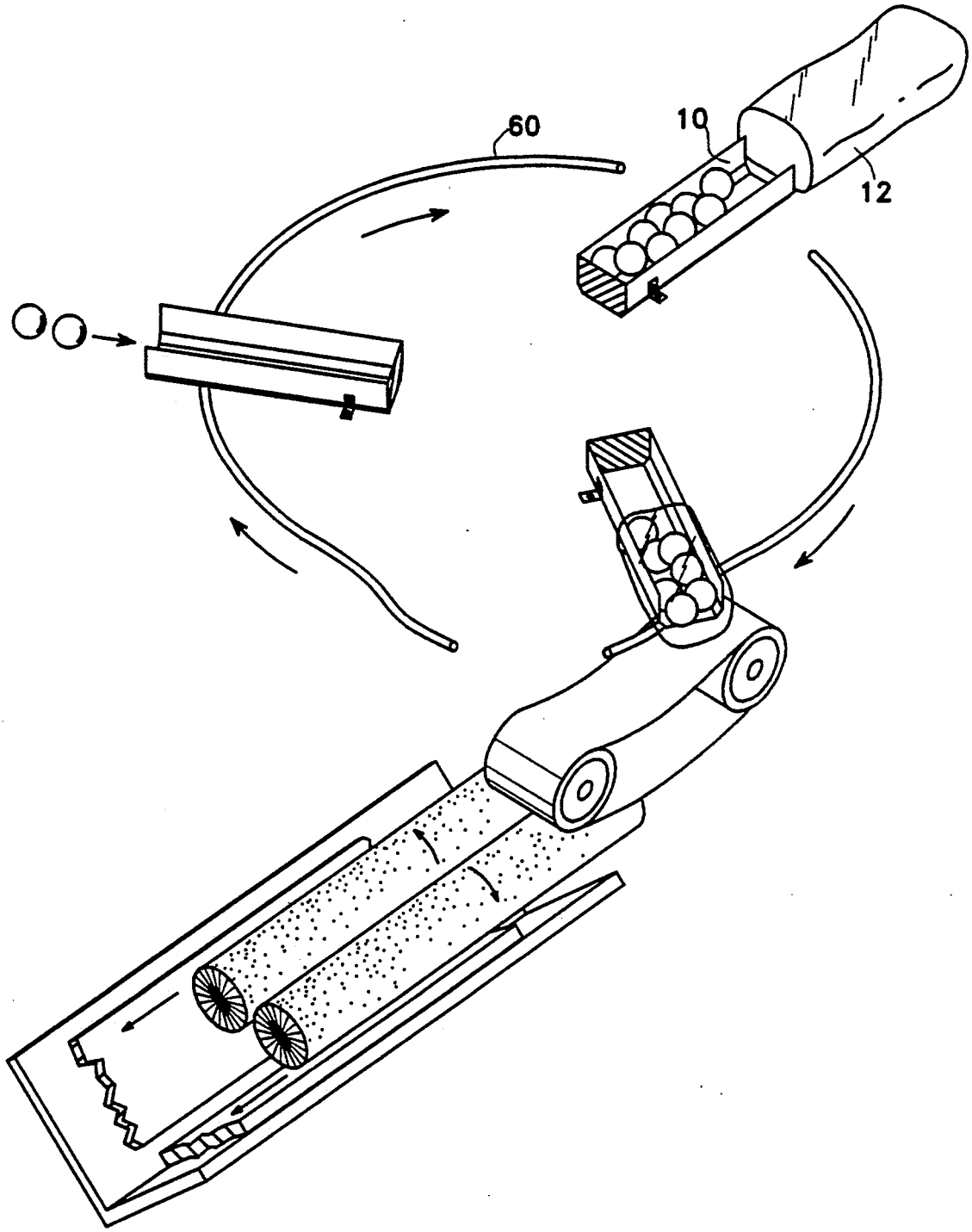
FIG. 9 is a perspective view of an alternative embodiment wherein a plurality of supports in series are employed.

Tilting of the support in this embodiment may be accomplished by reciprocating elements as described supra, and rotation may be effected by conventional means. Alternately, a circular or arc-shaped track or rail 60, as shown in FIG. 9 or 10, may be provided on which the support rides while rotating. By creating dips or sloping portions in the track, the support will tilt as it rotates.

As shown in FIG. 9, a plurality of supports may be positioned in series in a radial array, with the discharge end portion of each support extending radially outwardly. Again, means are provided for simultaneously tilting and rotating the supports as described above. In this embodiment, the articles are provided at a first position, the bag holder assembly is located at a second position around the array, and the supports are tilted at a third position. Again, an included conveyor may be provided to receive the bag filled with the articles as described above. The use of a series of supports in this embodiment would provide the obvious advantage of bagging an increased volume of articles.

It is understood that the foregoing detailed description is given merely by way of illustration and that modifications and variations may be made therein without departing from the spirit and scope of the invention. For example, the apparatus of the invention is not limited in use to bags, but could employ other containers conventional on the art. Further, other receivers for the filled bags may be substituted for the second conveyor to receive and/or transport the filled bags. Also, single extensible/retractable reciprocating elements may be employed rather than the pairs thereof as shown in the FIGS.

We claim:

1. An apparatus for bagging produce or other articles comprising:

at least one tiltable support means for temporarily holding a quantity of produce in an approximately horizontal position and having an open end portion for freely and unrestrainedly discharging the produce or articles when said support is tilted to a nonhorizontal position, bag supply means for providing a supply of bags, each of the bags having an open end and a closed end, means for positioning the open end of a bag around said support means so that said end portion of said support means is nearly adjacent to the closed end of the bag, means for simultaneously tilting said support means and the bag from said approximately horizontal position to an extent that produce or articles on said support means will gravitationally settle toward said closed end of the bag, and for returning said support means to said approximately horizontal position, conveyor means below said support for receiving and conveying the bag containing produce or articles from said support means when tilted, and positioned such that the bag does not drop a substantial distance from said support means to said conveyor means to prevent damage or bruising of the produce or articles, and means for lifting said support means out of a bag while tilted from said approximately horizontal position and returning said support means to said approximately horizontal position.

2. The apparatus of claim 1 wherein said means for positioning includes bag gripping means movable in relation to said support means and said bag supply means.

3. The apparatus of claim 2 wherein said means for positioning further includes means for moving said bag gripping means in relation to said support means and said bag supply means and is operative to move and position said bag gripping means to engage a bag from said bag supply means, remove the bag from said bag supply means and extend the bag around said support means such that said support means is at least partially inserted into the bas and wherein said end of the support means is nearly adjacent the closed end of the bag.

4. The apparatus of claim 1 further comprising means for releasably retaining a bag over said support means to prevent the bag from being inadvertently from said support means.

5. The apparatus of claim 4 wherein said means is releasably retaining comprises a pad or a brush.

6. The apparatus of claim 1 wherein said conveyor means is cushioned to avoid produce or article damage.

7. The apparatus of claim 1 wherein said means for tilting also simultaneously functions to rotate said support means in a horizontal plane with said end portion extending radially outwardly, and said conveyor means is inclined and positioned below the path of rotation of at least said end portion of said support means such that an upper portion of the inclined conveyor receives the bag positioned around said support means substantially at said approximately horizontal position, the bag being gradually removed from said support means onto said conveyor means as said support means is tilted and rotated.

8. The apparatus of claim 1 comprising a plurality of said support means positioned in a series.

9. The apparatus of claim 8 wherein said plurality of support means are positioned in series in a radial array, said end portion of each of said support means extending radially outwardly, and wherein said produce or articles are provided in said support means at a first position, said bag supply means is located at a second position to provide a bag for one of said support means, and said means for tilting is located at a third position different from said first and second positions.

10. The apparatus of claim 1 wherein said means for positioning and said means is tilting are pneumatically operated.

11. The apparatus of claim 1 further comprising computer control means effecting automatic operation.

12. The apparatus of claim 2 wherein said means for positioning includes a blower for inflating and preventing collapse of the bag.

13. The apparatus of claim 1 wherein said support means is a tray, hopper, or pan.

14. The apparatus of claim 1 wherein said means for tiling functions to tilt said support means to an approximately vertical position.

15. The apparatus of claim 3 wherein said means for moving said bag gripping means also functions to move said bag gripping means to a position above said support means after the bag is extended around the support means.

16. The apparatus of claim 1 further comprising conveyor means for supplying produce or articles to said support means.

17. An apparatus as described in claim 1 wherein said conveyor means is positioned such that the bag does not drop any distance from said support means to said conveyor means.

18. An apparatus for bagging produce or other articles comprising:

at least one tiltable support means for temporarily holding a quantity of produce in an approximately horizontal position and having an open end portion for discharging the produce or articles when said support is tilted to a nonhorizontal position, said support means not having means for retaining the produce or articles thereon when said support is tilted, bag supply means for providing a supply of bags, each of the bags having an open end and a closed end, means for positioning the open end of a bag around said support means so that said end portion of said support means is nearly adjacent to the closed end of the bag, means for simultaneously tilting said support means and the bag from said approximately horizontal position to an extend that produce or articles on said support means will gravitationally settle toward said closed end of the bag, and for returning said support means to said approximately horizontal position, conveyor means below said support for receiving and conveying the bag containing produce or articles from said support means when tilted, and positioned such that the bag does not drop a substantial distance from said support means to said conveyor means to prevent damage or bruising of the produce or articles, and means for lifting said support means out of a bag while tilted from said approximately horizontal position and returning said support means to said approximately horizontal position.

* * * * *